United States Patent [19]

Rogers et al.

[11] 4,204,420

[45] May 27, 1980

[54] LAMINATED BOARD AND HAMMER COMBINATION FOR A DROP HAMMER FORGE

[75] Inventors: Thomas E. Rogers; Richard J. Rogers; Peter T. Rogers; James G. Rogers, all of Marion, Wis.

[73] Assignee: Marion Plywood Corporation, Marion, Wis.

[21] Appl. No.: 846,163

[22] Filed: Oct. 27, 1977

[51] Int. Cl.[2] ..... B21J 7/36

[52] U.S. Cl. ..... 72/439; 428/106; 428/114; 428/332; 428/526; 428/535; 173/90; 156/299

[58] Field of Search ..... 428/106, 114, 213, 214, 428/535, 526, 332; 72/435, 439; 156/228, 281, 313, 335, 299; 173/90, 124, 92; 100/214

[56] References Cited

U.S. PATENT DOCUMENTS

| | | | |
|---|---|---|---|
| 255,619 | 3/1882 | Hague | 72/439 |
| 1,722,715 | 7/1929 | Teakle | 72/439 |

*Primary Examiner*—George F. Lesmes
*Assistant Examiner*—P. Thibodeau
*Attorney, Agent, or Firm*—Hill, Van Santen, Steadman, Chiara & Simpson

[57] ABSTRACT

A laminated veneer hammerboard for a drop forge press comprised of a series of plies of hard, high density wood preferably of the order of a peeled hard maple veneer with the grain of at least most of said veneer plies running along its length, each of said plies of the hammerboard having a thickness in the range of 1/32" to 3/16", and glue deposited between the plies securing the plies together and providing a relatively large number of hard glue surfaces enhancing the wearability of the board. Vertical edges of each ply being disposed at opposite ends of the hammerboard rather than along the width thereof, thus enabling each roller to engage an outer side surface of the outermost ply on each side of the hammerboard rather than directly against opposite vertical edges of each ply.

12 Claims, 4 Drawing Figures

Fig. 1
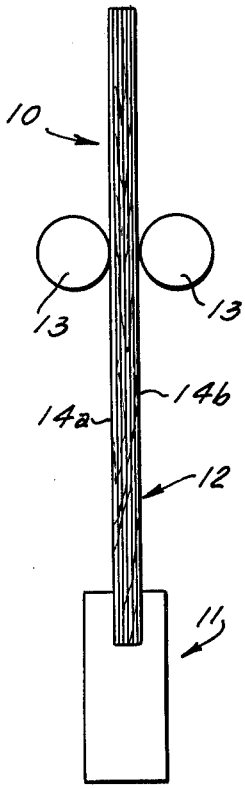
Fig. 3
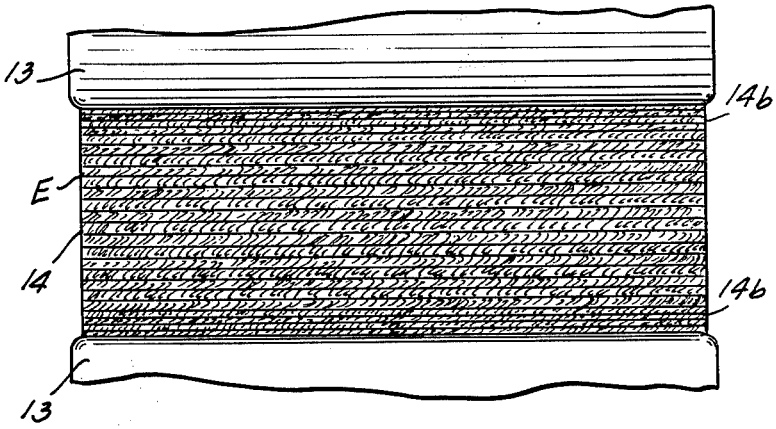
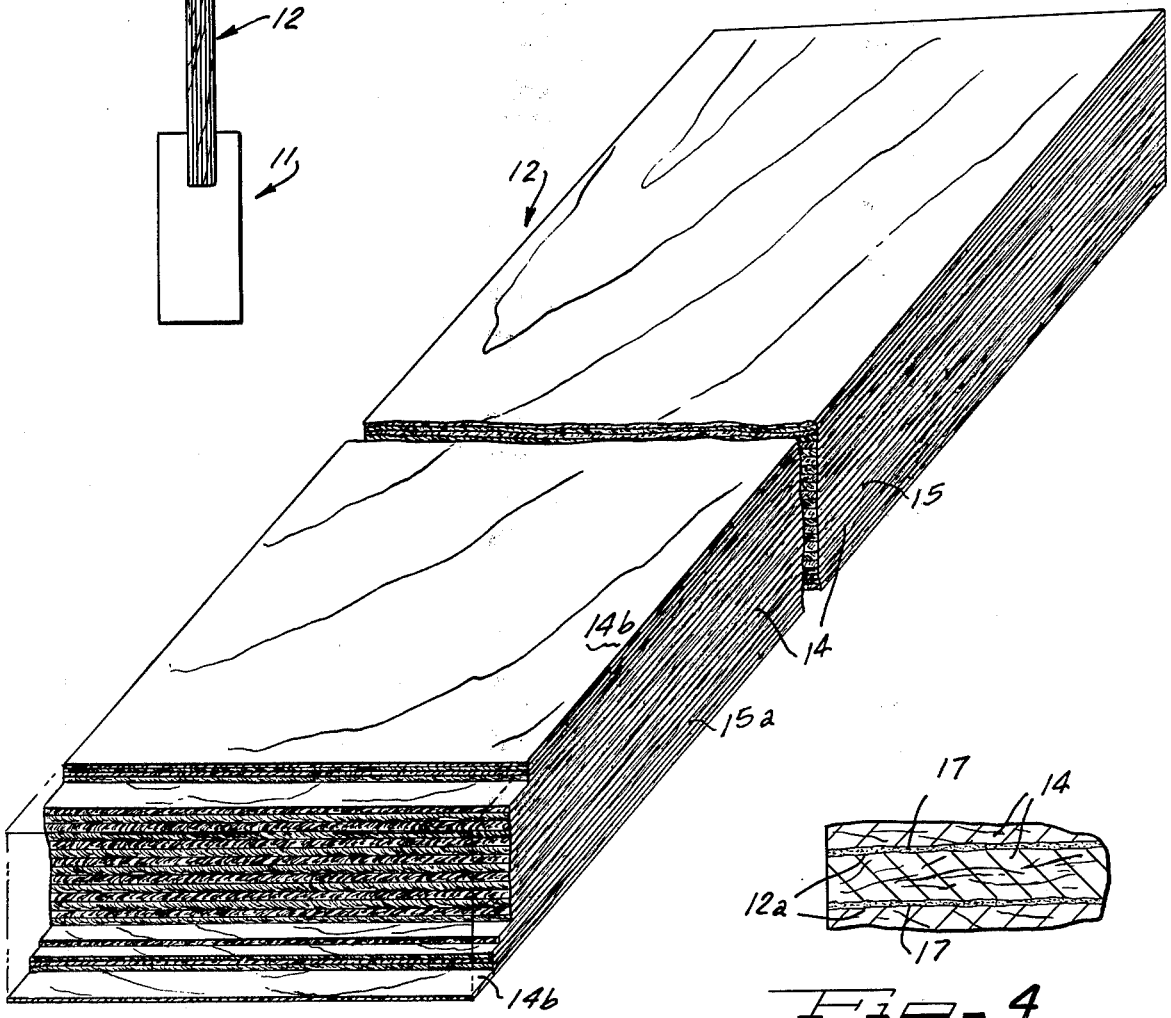
Fig. 2
Fig. 4

LAMINATED BOARD AND HAMMER COMBINATION FOR A DROP HAMMER FORGE

BACKGROUND OF THE INVENTION

The present invention relates to a new and improved hammerboard for a drop forge press. More particularly the invention concerns a laminated plywood hammerboard comprising a series of very thin plies of hard, high density wood veneer with the grain of each ply of veneer running along its length, each ply having nonsawed peeled opposed surfaces providing glue surfaces thereon. The plies of the hammerboard are of a relatively thin construction and glue is disposed on the surfaces to secure each of the plies together to provide a new and improved manner.

Drop hammerboards are used in a common type of drop hammer forge. They are widely used in the forging industry throughout the world with heavy concentrations in the upper Midwest.

Specifically, a drop hammer forge has a stationary die and a moving die. This moving die is fastened onto a large weight (hammer) which is pulled up and then falls free onto the stationary die. One end of the drop hammerboard is clamped onto the hammer and the other end extends straight up between two rollers. These rollers clamp the board and pull the hammer assembly up. The rollers then release and allow the hammer to fall. There is also a brake to hold the board and hammer in the up position.

Present construction of boards: Boards are now made of hard maple lumber. Either one piece or several pieces laminated together. One variation is a layer of leather glued in. The approximate sizes used range from 1¼" to 2-1/16" thick, 7' to 15' long, and 3" to 12" wide.

Problems with present boards: The boards are subject to extreme shocks when the hammer hits bottom. They frequently break before they are worn out with estimates of premature breakage running upwards of 50%. Another problem is that the rollers wear the boards out, with the time dependent on the particular shape being forged. These problems lead to frequent shut downs to replace broken and worn boards and some danger to personnel with the flying pieces.

Our solution is to manufacture these boards from hard wood veneer having the grain oriented so as to extend the length of the board in one preferred embodiment. We start by cutting hard maple logs into veneer 1/32" to 3/16" thick and then we glue this veneer back together into panels of the proper size for drop hammerboards. This process allows us to engineer the boards to reduce or eliminate the breakage and improve the wearing properties.

In hammerboards, the laminated lumber construction has been known for many years. The newly developed preferred hard wood veneer type laminated hammerboard as herein disclosed has been found to work in a much improved manner over anything previously known to have been used and the life of such a board has been found to greatly exceed the useful life of other hammerboards used just before this invention. Laminated lumber hammerboards are formed from sawed layers as distinguished from the peeled layers of veneer used on our new board.

In view of the improved characteristics of the herein disclosed hard wood veneer type laminated hammerboard, an important object of this invention is to provide a hammerboard construction that has a life expectancy far exceeding any other known hammerboard, and to reduce down time for the user.

Another object of this invention is to provide a hammerboard construction that can be manufactured at least in part with known manufacturing procedures, and in such a way that the hammerboards can be produced on a production basis to satisfy the need of the marketplace.

Another object of this invention is to provide a new and improved method of manufacturing hammerboards having peeled layers.

Still a further object of this invention is to provide a new and improved laminated plywood hammerboard comprised of a series of very thin hard, high density wood material with the grain of each ply of the veneer running along the length of the hammerboard and with glue being disposed on the surfaces provided in peeled surfaces of each ply, thus providing a tough bond and a hammerboard that has a life expectancy far exceeding any previously known hammerboards.

According to an important feature of this invention, we have provided a laminated plywood hammerboard for a drop forge press comprised of a series of plies of hard, high density wood maple veneer with the grain of at least most of said plies running along its length and with each of the plies having a thickness in the range of 1/32" to 3/16", and glue being deposited between the plies securing the plies together and providing a relatively large number of hard glue surfaces enhancing the wearability of the board.

Other features of the present invention relate to providing different types of hammerboards, at least one of which has a useful life of 170 hours by first using the board with one end attached to a hammer on a drop hammer forge and then by rotating the board 180 degrees and reattaching the opposite end of the board to the hammer for another period of use.

According to other features of this invention, we have provided a new and improved hammerboard having plies of varying cross-sectional thicknesses and with the plies disposed in closest adjacency to opposite sides of the hammerboard having a thinner cross-sectional thickness than those plies disposed interiorly of the hammerboard, the plies being so oriented that the opposite vertical edges of the plies are disposed at opposite ends of the hammerboard so that one roller for lifting the hammerboard is only engaged against one thinner ply on one side of the hammerboard and another roller is only engaged against a thinner ply on an opposite side of the hammerboard.

Other objects, features and advantages of the invention will be readily apparent from the following description of representative embodiments thereof taken in conjunction with the accompanying drawing although variations and modifications may be effected without departing from the spirit and scope of the novel concepts embodied in the disclosure and in which:

FIG. 1 is a diagrammatic view of the combination of a new and improved hard wood veneer type hammerboard and a ram for a drop forge press;

FIG. 2 is a fragmentary perspective view in full and dotted lines of a preferred embodiment of our new laminated veneer hammerboard illustrated in FIG. 1;

FIG. 3 is a top plan view of a modified type of a hammerboard where its veneer laminations have grain structure all extending in a common direction; and FIG. 4 is an enlarged fragmentary view illustrating the manner of cooperation of the glue therein for securing the laminations in assembly.

In FIG. 1, the reference numeral 10 diagrammatically illustrates a drop forge press. This pres may be of any suitable type. A number of issued U.S. patents generally relate to this subject and attention is directed to typical U.S. Pat. Nos. 2,204,222; 2,604,071 and 3,080,778, among others.

In FIGS. 1, 2, 3 and 4 is illustrated a particular type of laminated hammerboard where each laminate is comprised of hard, high density wood veneer. As illustrated in FIG. 1, the hammerboard 12 has opposite sides 12*a*,12*a* which are adapted to be engaged by a pair of lift rollers 13,13 which when operated serve to elevate the ram 11 and when the rollers are released at a predetermined height, gravity operates to cause the ram to strike an anvil to cause parts to be forged. The hammerboard 12 is comprised of a series of veneer laminations 14 where the grain of each lamination or ply runs along the length of the hammerboard. The common plywood construction is such that the plywood is comprised of a series of plies and where the plies are disposed on top of one another with one ply having its grain structure running in one direction and with the next ply having its grain structure running at right angles and with the succeeding ply having its grain structure running in the same direction as the first mentioned ply.

Peeled surfaces 14*a* of the plies 14 are glued (FIG. 4) at 17 and it will be noted that the glue lines extend outwardly to the wear surface of the board so as to coact with the rollers 13,13.

Field tests have been run by users of hammerboards. One user, employing a new hammerboard press, has run a hammerboard of the type shown in FIGs. 2 and 3 for 170 hours. This extended life is contrasted with old type hammerboards of other constructions that are being marketed by other manufacturers and which have been tested and found to have a useful life of only 27 hours. It is thus believed that the new and improved results of the herein disclosed hammerboards are definitely superior to any known prior art hammerboard. In this respect, it will be noted that the hammerboard shown in FIG. 2 is of the type where the rollers engage the opposite sides of only a pair of plies and against face grain wood.

Illustrated in FIGS. 2 and 3, is the hammerboard 12. The hammerboard 12 has its veneer plies 14 and 14*a* which may have rough opposed surfaces, but the plies are cut in a hammer such that each of the rollers 13 on each side of the hammerboard 12 is adapted to engage against a single ply 14 rather than against the vertical edges E of a series of plies. Still further, the laminations 14*b* disposed in immediate adjacency to each opposite side of the hammerboard 12 are of a reduced thickness as compared to the other plies. The thinner plies are indicated at 14*b*. By employing thinner plies, 14*b* at opposite sides of the hammerboard 12, the hammerboard 12 can be strengthened and the likelihood of peeling of the plies can be reduced. The thinner plies an be of the order of 1/24" thick where the other plies are 1/14" thick.

As shown in FIG. 2, the plies 14 and 14*a* are each comprised of a series of pieced-together ply sections or plies with associated sections or plies having edges disposed in edgewise-abutting relation as indicated at 15 and 15*a*. Thus, each of the butt-engaged plies or sections that are associated extend generally in a common plane.

It will be seen that the hammerboard in FIG. 2 has plies of varying cross-sectional thicknesses disposed inclosest adjacency to opposite sides of the hammerboard and having a thinner cross-sectional thickness than those plies disposed interiorly of the hammerboard. Here, the plies are so oriented that the opposite edges of the plies are disposed at opposite ends of the hammerboards so that the rollers for lifting the hammerboard are only engaged against one thinner ply on one side of the hammerboard and only against a thinner ply on an opposite side of the hammerboard.

With the embodiment shown in FIG. 2, tests have been run and it has been found that where a hard, high density maple veneer grain structure has been provided in the plies of the hammerboard and where such a hammerboard is used in a drop forge press that the useful life of the hammerboard is roughly 120 hours by first using the board with end attached to a hammer on a drop hammer forge and after 60 hours of use, rotating the board 180 degrees and reattaching the opposite end of the board to the hammer for another 60 hours use. In the board thus used, it had a dimension of approximately 1½ inches, 8 feet long, and 9 inches to 12 inches in width.

Method of Manufacture

The present invention also involves a new and improved method of manufacturing hammerboards for the drop hammer forge industry.

The hammerboard described herein is manufactured from wood veneer rather than laminated lumber. The improved, newly discovered drop hammerboard is a laminated plywood board and has properties that are unique from the lumber board.

Our process starts with veneer logs. In a preferred embodiment hard maple is used because the forging industry has used it for years; it is readily available throughout the eastern U.S. and Canada; it has superior wearing and hardness characteristics, and we are skilled in its use. There are other woods that may work as well because of the internal reinforcement available in our hammerboard, but we have not had the opportunity to test them yet.

A list of suggested woods and comparisons of their strength has been taken by us from the U.S. Department of Agriculture Handbook, No. 72, printed in 1955. The handbook does not go into detail on how these tests were performed so the numbers listed are only good for comparisons within each table. Other woods with similar strengths could be suitable, but further testing would be required. The reinforcement available with glues and the interlocking grain may make some of the slightly softer woods worth testing. The aforesaid handbook reports as follows:

| Toughness, Table 14 Extract | Radial | Tangential |
|---|---|---|
| Yellow Birch | 260 | 330 |
| Elm, Winged | 350 | 360 |
| Elm | 250 | 290 |
| Maple, Sugar | 190 | 190 |
| Oak, Pin | 230 | 220 |

| Strength properties, Table 12 Extract | Shear(13) | Hardness |
|---|---|---|
| Maple, Sugar | 2330 | 1450 |
| Ash, White | 1950 | 1320 |
| Birch, Yellow | 1880 | 1260 |
| Elm, Cedar | 2240 | 1320 |
| Elm, Winged | 2370 | 1540 |
| Elm, Rock | 1920 | 1320 |

-continued

| | | |
|---|---|---|
| Red Oak, Northern | 1780 | 1290 |
| White Oak | 2000 | 1360 |

| Machining properties, Table 11, Nail Splitting % Free from Defects | |
|---|---|
| Ash | 65 |
| Beech | 42 |
| Birch | 32 |
| Elm | 80 |
| Hickory | 35 |
| Hard Maple | 27 |
| Soft Maple | 58 |
| Red Oak | 66 |
| White Oak | 69 |

The hard maple logs are first heated in a steam room, pond, or in some manner that will warm the log. This softens the wood and makes it more flexible. Next, the bark is removed because it is usually full of sand and dirt that will dull the cutting knife. The veneer cutting is usually done with a knife. Veneer can be cut with a saw but it would be very wasteful and expensive. Preferably, the veneer is cut on a rotary lathe which, in our opinion, has certain economic advantages, but there are other methods of cutting veneer such as slicing and halfrounding which would produce useful veneer. A rotary lathe consists of a long knife against which the log is rotated, the log being clamped to the lathe. This process peels off a continuous thin layer of veneer from around the circumference of the log. The process is continued until most of the log is converted into veneer. As the continuous sheet comes off the lathe, it is clipped into pieces for easier handling. The good logs without serious defects are clipped into whole sheets so they can go to the press after drying with only minor trimming. Any veneer with unallowable defects is clipped so it is free of such defects. The clipped sheets are smaller than full sheets, and we call them random width sheets. These random width sheets will be spliced back together so they are full sheet size after they are dried. The veneer is dried to 6%–8% moisture content in a conventional veneer dryer. The random width sheets are spliced into whole sheet sizes, then treated like whole sheets are after drying. Splicing is just fastening narrow sheets of veneer together to make a full width sheet. We splice with glue but tape or thread can be used or any technique that will join the veneer.

The next step of manufacture employs a layup table. First, a dry sheet of veneer is put on the table, then a sheet is run through a glue spreader and glue is applied to both sides (wet sheet). The glue can be applied many different ways. What is important is that a proper spread of glue is put between each sheet of veneer. This wet sheet is placed on the dry sheet and the procedure is repeated . . . wet sheet, dry sheet, wet sheet, dry sheet . . . until sufficient thickness is reached. In this layup, all of the veneer runs the same way (parallel laminate) but minor variations in grain direction within the veneer will, when glued together, interlock to prevent splitting of the panel.

The boards are made with four layers of 1/24" thickness veneer. On each face, because the glue penetrates the wood, fills the void and locks the fibers together, by using four layers of thin veneer, we obtained a larger percentage of impregnation of the R-14 "Resorcinol" glue into the wood, thereby reinforcing the same. In effect, it appears that each layer of this glue provides a tough, durable finish. It appears that the R-14 "Resorcinol" glue penetrates each sheet of veneer on each side with glue from 3 to 5 thousandths of an inch and in some cases the glue penetrates much further. The subsequent tests supported our preliminary views. The boards with the four plies of 1/24" on opposed sides, wore longer than boards with all layers of 1/14" veneer. It was also observed that after the four layers of the R-14 "Resorcinol" glue reinforced plies wore off, on each side of each board, each started to wear much faster. With a 1½" wide board, excellent results can be obtained by manufacturing the board with 28 plies, including twenty 1/14" plus four 1/24" plies on each side.

Excellent results have been obtained using R-14 "Resorcinol" glue from National Casein which comprises a modified resorcinol-formaldehyde adhesive. We apply this glue in a glue spreader at 50# per MSF (thousand sq.ft.) double glue line. The center of the panel needs to achieve 180°–190° F. to cure this glue. An expert could also use formulas with phenolic resins and caseins. In any case, the procedure would need to be modified to suit the formula.

The bundle of dry and wet sheets is pushed into a press, squeezed together, then the glue is allowed to cure. A press with live steam in the platens can be successfully used. This heats the panel and speeds up the curing process. Electronics can also be used to heat the glue to speed curing or use a glue that will set at room temperature. Our 12' hot press is heated to 300° F. and presses at 250 to 300 PSI until the glue is set. This process allows us to make large blanks which may be sawed up into the individual hammerboards.

We usually make up wide blanks to the proper thickness and length and then saw the correct widths out of this blank.

| Thick | | Wide | | Long |
|---|---|---|---|---|
| 1⅝" | × | 7½" | × | 96" |
| 1¾ | | 8 | | 126 |
| 1½ | | 6 | | 96 |
| 1½ | | 12 | | 96 |
| 1⅝ | | 7½ | | 105 |
| 1⅞ | | 6 | | 148 |
| 1-15/16 | | 5 | | 108 |
| 1½ | | 7 | | 115 |

Thicknesses commonly range from 1¼" to 2"; widths from 3" to 8"; and lengths from 8' to 16'.

The primary difference that should be pointed out with these boards is that they are made out of veneer and not lumber. The processes of manufacturing veneer and lumber and pressing them into boards is different in many phases and results in wood products with different characteristics. These individual characteristics can be used separately or in combination to make the panel or board to meet your needs. The logs to be veneered must be heated whereas the logs to be sawed are left cold. Cutting veneer uses a knife. Sawing lumber uses a saw. Veneer is dried in a veneer dryer and lumber is dried in a dry kiln. Lumber is pressed in a press with side pressure and veneer is pressed in a press with top pressure. So, almost all stages of the manufacturing process are different.

Using veneer leads to a superior hammerboard. In a lumber hammerboard a knot or a small patch of short grain usually results in a broken board and lost production on the forge. A veneer board uses small knots, cross grain, and grain variation to increase its strength. By turning every sheet of veneer, we take advantage of these variations. Each layer reinforces the one next to it. The entire board is internally reinforced making it much stronger than the average lumber board.

If thin veneer is used, the glue will go into the pores and cracks of each sheet. This reinforces the wood fiber and helps interlock each layer together. The interlocking between veneer layers makes the board stronger decreasing board breakage. The reinforcing of wood fiber helps to increase wear resistance of the board. These two factors result in a stronger board that lasts longer. The reduced down time on the drop hammer forge because of these factors results in a significant advantage to the forging industry.

These boards are significantly different from the laminated lumber boards in that: (1) They are made out of wood veneer and not lumber. (2) This wood veneer uses production processes and equipment that is unique from lumber but standard in the plywood industry. (3) The boards made from wood veneer are internally reinforced by the grain of the wood and the glue in ways that are not readily available to the lumber boards. (4) The veneer boards have a significantly greater life expectancy due to reduced breakage and greater wear resistance. (5) The use of veneer allows inclusion of lower grade wood and eliminates saw kerf thus resulting in more efficient utilization of the wood fiber used in them. (6) The drop hammer forge industry has been seeking an answer to their board problem for many years. These boards are part of the answer. Our laminated veneer hammerboards help cut one of the largest expenses of the least energy demanding forging techniques.

There are a great many thicknesses of veneer that would work and as many layups for putting them together. Two of the factors that must be considered when choosing a thickness are: (1) availability in the market, and (2) compatibility with other veneer used in the plant.

Some advantages of thick veneer:

1. Fewer pieces to handle saves labor.
2. Fewer pieces in boards saves glue lines.
3. Fewer glue lines means less water and fewer steam blows.

Some disadvantages of thick veneer:

1. Harder on machinery—may need special machinery.
2. More lathe checks and rougher cutting means reduced strength.
3. More difficult to splice and clip.

Some advantages of thin veneer:

1. Easier on machinery
2. Easier to splice, etc.
3. Fewer and smaller lathe checks, smoother cut veneer.
4. Glue reinforces larger percentage of wood.

Some disadvantages of thin veneer:

1. More pieces to handle (more labor).
2. Uses more glue.
3. Moisture from the glue causes steam blows.

After considering the above factors, we chose 1/14" and 1/24" veneers because they are compatible with our other products. Other thicknesses would work and we could easily switch.

Typical layup for 1½" panel—use different layups for other thicknesses:

4 layers 1/24"
17 layers 1/14"
4 layers 1/24"
All grain to run in long direction.

All the grain runs the same way (parallel laminate) and we allow 1" knot holes and small splits on the interior plies. The outside layers should be sound. No rot, doze (form of wood rot and it makes wood soft), or similar defects allowed unless less than 1" in diameter. A few crossbands may work in these panels but we have not had the opportunity to test them. For boards that are longer than the veneers available, we butt join the veneer together to make the necessary length. Care should be taken so that joints do not coincide without five or six layers between. Another method of joining such as scarf joining would be beneficial. The above described hot-press procedure and the state of technology of this art does not presently allow veneers to be cut having a thickness much less than 1/32". It has also been found that where the amount of glue has been increased, that the hammerboard produced is stronger.

We claim as our invention:

1. In a drop forge hammer board press having lift roller means and a hammer, a laminated veneer hammerboard attachable at one end to the hammer and, engageable at an opposite end with the lift roller means, the improvement comprising the hammer board being comprised of a series of plies of hard, high density wood of the order of a peeled hard maple veneer with the grain of at least most of said veneer plies running along its length, each of said plies of the hammer board having a thickness in the range of 1/32" to 3/16", and glue deposited between the plies securing the plies together and providing a relatively large number of hard glue surfaces enhancing the wearability of of the board, vertical edges of each ply being disposed at opposite ends of the hammer board rather than along the width thereof thus enabling the roller means to engage opposite surfaces of the outermost ply on each side of the hammer board rather than directly against the vertical edges of each ply.

2. The hammerboard press of claim 1 further characterized by the plies having varying cross-sectional thicknesses and with the plies disposed in closest adjacency to opposite sides of the hammerboard having a thinner cross-sectional thickness than those plies disposed interiorly of the hammerboard, the plies being so oriented that the opposite vertical edges of the plies are disposed at opposite ends of the hammerboard so that roller means for lifting the hammerboard are only engaged against one thinner ply on one side of the hammerboard and only against a thinner ply on an opposite side of the hammerboard.

3. The hammerboard press of claim 1 further characterized by having its hard density maple veneer grain structure so oriented as to have a useful life of roughly 120 hours by first using the board with one end attached to the hammer and after 60 hours use, rotating the board 180° and reattaching the opposite end of the board to the hammer for another 60 hours use, said board being approximately 1½" thick, 8 feet long and 9" to 12" wide.

4. The hammerboard press of claim 1 further characterized by at least certain of said plies each being comprised of a series of pieced-together ply sections with associated sections having edges disposed in edgewise abutting relation and with each of the thus associated sections extending in a common plane.

5. The hammerboard press of claim 2 further characterized by said thinner plies each being 1/24" in thickness.

6. The hammerboard press of claim 1 further characterized by interior plies preferably having a thickness of 1/14" and exterior located plies having a thickness of the order of 1/24".

7. The hammerboard press of claim 1 further characterized by said board including twenty 1/14" plies plus four 1/24" plies on each side.

8. The hammer board press of claim 1, further characterized by said glue comprising a modified resorcinol-formaldehyde adhesive.

9. In a drop forge hammer board press having lift roller means and a hammer, a laminated veneer hammer board attachable at one end to the hammer and engageable at an opposite end with the lift roller means, the improvement comprising the hammer board being comprised of a series of plies of hard, high density wood of the order of a peeled hard maple veneer with the grain of at least most of said veneer plies running along its length, each of said plies of the hammer board having a thickness in the range of 1/32" to 3/16", and glue deposited between the plies providing glue lines which secure the plies together and providing a relatively large number of hard glue surfaces enhancing the wearability of the board, vertical edges of each ply being disposed at opposite ends of the hammer board rather than along the width thereof thus enabling the roller means to engage opposite surfaces of the outermost ply on each side of the hammer board rather than directly against the vertical edges of each ply, the plies having varying cross-sectional thicknesses and with the plies disposed in closest adjacency to opposite sides of the hammer board having a thinner cross-sectional thickness than those plies disposed interiorly of the hammer board, the plies being so oriented that the opposite vertical edges of the plies are disposed at opposite ends of the hammer board so that the roller means for lifting the hammer board are only engaged against one thinner ply on one side of the hammer board and only against a thinner ply on an opposite side of the hammer board, said thinner plies each being 1/24" in thickness.

10. The hammerboard press of claim 7 further characterized by said board including twenty 1/14" plies plus four 1/24" plies on each side.

11. The hammerboard press of claim 10 further characterized by having its hard density maple veneer grain structure so oriented as to have a useful life of roughly 120 hours by first using the board with one end attached to the hammer and after 60 hours use, rotating the board 180° and reattaching the opposite end of the board to the hammer for another 60 hours use, said board being approximately 1½" thick, 8 feet long and 9" to 12" wide.

12. The hammerboard press of claim 7 further characterized by said glue penetrating at least from 3 to 5 thousandths of an inch.

* * * * *